United States Patent [19]

Dubinsky

[11] Patent Number: 4,909,400

[45] Date of Patent: Mar. 20, 1990

[54] ROTATING MERCHANDISING STAND

[76] Inventor: Ronald P. Dubinsky, 750 Jaguar Dr., Bordman, Ohio 44512

[21] Appl. No.: 189,024

[22] Filed: May 2, 1988

Related U.S. Application Data

[63] Continuation of Ser. No. 46,705, May 7, 1987, abandoned.

[51] Int. Cl.[4] ..... A47F 7/00

[52] U.S. Cl. ..... 211/70; 211/163

[58] Field of Search ..... 211/70, 77, 131, 129, 211/163, 13, 69; 108/103; 248/146; 206/562, 563; 220/23.8

[56] References Cited

U.S. PATENT DOCUMENTS

| | | | |
|---|---|---|---|
| 49,840 | 9/1865 | Young | 211/77 |
| 311,613 | 2/1885 | Shelden | 211/70 X |
| 3,452,880 | 7/1969 | Kovacik et al. | 211/129 X |
| 3,858,529 | 1/1975 | Salladay | 211/163 X |

FOREIGN PATENT DOCUMENTS

| | | | |
|---|---|---|---|
| 124646 | 6/1928 | Switzerland | 211/131 |

*Primary Examiner*—Alvin C. Chin-Shue
*Assistant Examiner*—Sarah A. Lechok
*Attorney, Agent, or Firm*—Clifford A. Poff

[57] ABSTRACT

A rotating merchandising stand is disclosed for the display of merchandise contained in tubular containers, such as tubes of haircolor. A circular merchandise support tray containing a plurality of truncated conical cavities extending therein from a top surface of the tray to allow rotation of the tray about the base. The tapering side walls of the conical cavities support tube caps of the tubular containers to allow the tubes to be supported in an upstanding position upon the tray.

8 Claims, 2 Drawing Sheets

ROTATING MERCHANDISING STAND

This is a continuation of co-pending application Ser. No. 046,705 filed on May 7, 1987 now abandoned.

BACKGROUND OF THE INVENTION

1. Field of the Invention

The present invention relates generally to merchandise display apparatus, and more particularly, to the display of tubular products.

2. Description of the Prior Art

A prerequisite for successfully marketing a retail product is to make the consumer away of the product. To effectuate such an awareness, merchants make attempts to prominently display products. Frequently, the products are of small sizes and a large number of the products are required to be stacked upon one another and displayed theretogether whereby the combined array of products creates a visual effect suitable to make the consumer visually aware of the product.

Oftentimes, products are not of shapes suitable to allow stacking thereof whereby a combined array of the products may be displayed theretogether. In such instances, the products may be placed in containers, such as rectangular boxes, to allow stacking of the products. Usually, the containers serve no other useful purpose, are disposed of by the consumer once the product is purchased, and constitute an additional expense to the manufacturer of the product.

Disclosed in the prior art are various article display stands which function to display articles of merchandise utilizing a lazy susan principle. A lazy susan is a revolving trayy allowing positioning thereupon of articles. Lazy susans are especially useful for supporting articles which cannot be stacked one upon another, as the lazy susan provides the support means for supporting the articles. For example, U.S. Pat. No. 1,782,257 discloses a revolving display stand equipped with a plurality of graduated shelves allowing articles to be positioned on the shelves. Similarly, U.S. Pat. No. 3,266,634 discloses a rotary display stand having a plurality of shelves, and further includes on each shelf a large number of receptacles to receive a large number of small articles such as knobs, hinges, or etc. U.S. Pat. No. 3,858,529 discloses a lazy susan which is rotated by the use of a ball bearing assembly. Further, U.S. Pat. No. 4,030,608 discloses an article display stand having a number of vertically arranged shelves wherein each shelf has separate article display pockets. Finally, U.S. Pat. No. 4,269,124 discloses a merchandise display rack containing a large number of shelves supported from an elongated, vertically disclosed column. The trays are flat surfaces particularly suited for displaying shoes thereupon.

No display rack disclosed in the prior art, however, provides a means for supporting articles of merchandise in a precise orientation in order to create an enhanced visual effect of those products. In some instances, merely placing articles of merchandise on the shelves of the prior art display racks does not create a visual effect suitable to generate a consumer awareness of the merchandise.

One such example of merchandise which must be supported in a particular manner is merchandise which is packaged in turuble containers. Merchandise packaged in tubular containers suffer from an inherent structural disadvantage in that the tubes cannot be stacked upon one another to allow a combined array of tubes to be displayed. Even when displayed upon the rotating display stands of the prior art, tubular containers by their very construction do not create a visual effect suitable to generate a consumer awareness of the merchandise.

Haircoloring products are frequently packaged in tubular containers and are available in a large number of shades. Because a limited amount of space is available for display of merchandise, display of haircolor on rotating display stand is quite advantageous. However, because haircoloring products frequently are contained in tubular containers, positioning of such tubes on the displays stand does not create a visual awareness in a consumer adequate to market the product.

What is needed, therefore, is a means by which rotating display stands may be adapted to prominently display merchandise, such as haircoloring products, which is packaged in tubular containers.

It is therefore an object of the present invention to provide a rotating display stand suitable for displaying thereupon merchandise contained in tubular containers.

It is a further object of the present invention to provide a rotating display stand which displays merchandise contained in tubular containers in an upstanding position.

It is a still further object of the present invention to provide a rotating display stand which supports tubes of haircolor in an upstanding position to provide a consumer with a visual awareness thereof.

SUMMARY OF THE INVENTION

In accordance with the present invention, a rotating merchandising stand for displaying merchandise is disclosed. The stand includes a base means, and a merchandise support tray rotatably coupled to the base means for supporting merchandise thereupon. The merchandise support tray further contains a plurality of truncated conical cavities with tapering side walls extending into the support tray. The cavities allow insertion therewith of portions of merchandise. By causing the tapering side walls of the truncated conical cavities to correspond to the outer diameter of tube caps of tubes of merchandise, merchandise packaged in tubes, such as tubes of haircolor, may be supported by the side walls of the cavities in upstanding positions. The support tray may be rotatably coupled to the base means by a ball bearing unit wherein a bottom portion of the unit is fixedly attached to the base, a top portion of the unit is fixedly to the support tray, and ball bearings are rotatably positioned therebetween. Preferably, the merchandise support tray is a circular tray, and the truncated conical cavities form a series of circular patterns about the center of the circular tray.

In a further embodiment of the present invention, the rotating merchandising stand further includes at least one vertically extending support member fixedly attached at one end of thereof to the merchandise support tray. An additional second merchandise tray may thereafter be attached to the vertically extending support member to be supported above the first merchandise support tray. The second merchandise support tray may further include a plurality of truncated conical cavities having tapering side walls extending into the second merchandise support assembly to thereby allow additional merchandise, such as additional tubes of haircolor, to be supported upon the merchandise support assembly.

In a yet further embodiment of the present invention, a second ball bearing unit is attached to the vertically extending support member. Positioned upon an upper portion of the ball bearing unit is a second merchandise support tray. The second merchandise support tray may similarly include a plurality of truncated conical cavities having tapering side walls extending into the support tray to thereby allow merchandise, such as tubes of haircolor, to be supported thereupon. The use of the second ball bearing unit allows independent rotation of the second merchandise support tray.

BRIEF DESCRIPTION OF THE DRAWING

The features and advantages of the present invention will be more fully understood when the following description is read in light of the accompanying drawings in which.

DESCRIPTION OF THE PREFERRED EMBODIMENTS

Figure 1:
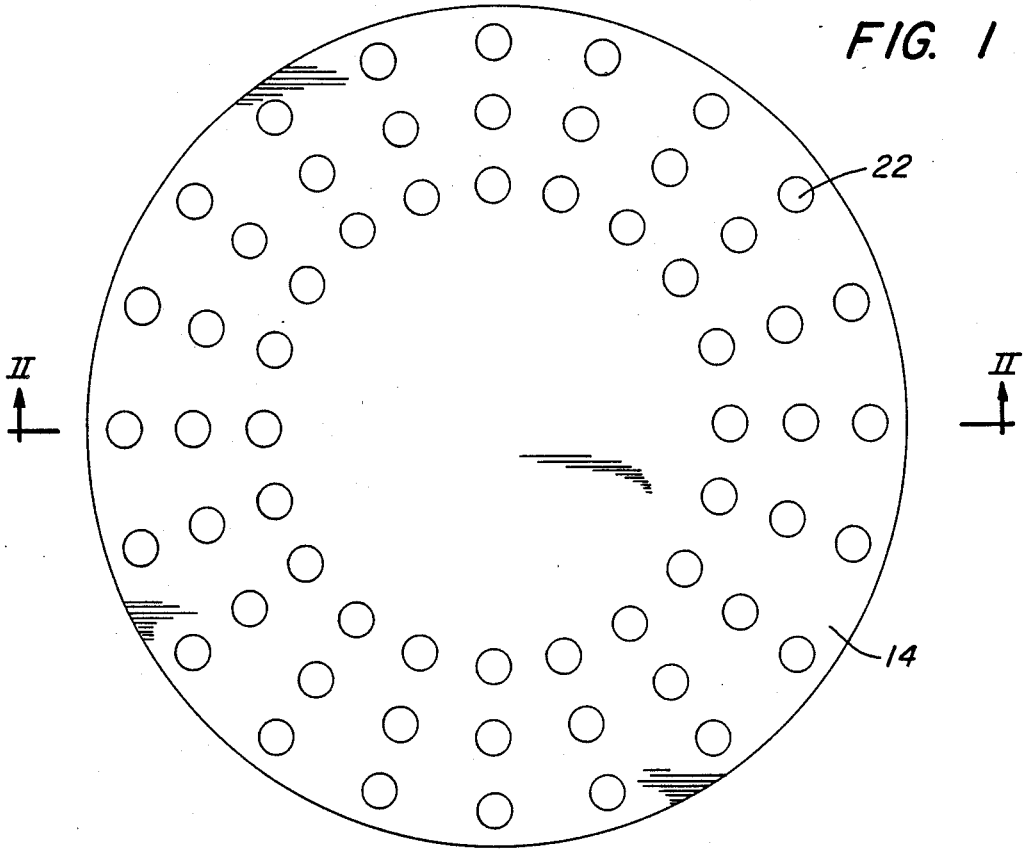
FIG. 1 is a cross-sectional view of a first embodiment of the rotating merchandising stand of the present invention.

Referring to FIG. 1 there is illustrated the rotating merchandising stand, shown generally as 10, of the present invention. Stand 10 is comprised of a skid-resistant base 12 having a merchandise support tray 14 positioned thereabove. Tray 14 is rotatably coupled to base 12 by means of a ballbearing unit 16. Ballbearing unit 16 includes a top portion 18 which is fixedly attached to support tray 14 and a bottom portion 20 which is fixedly attached to base 12. A plurality of ball bearings 22 are positioned between the top portion 18 and the bottom portio 20 of ball bearing unit 16 to allow rotation therebetween.

A plurality of truncated conical cavities 22 extends into tray 14 to allow tube caps 24 of tubes 26 to extend therein. Because the sidewalls of cavities 22 are tapered, and conform to the outer dimensions of tube caps 24, the tubes 26 are supported in an upstanding position.

Figure 2:
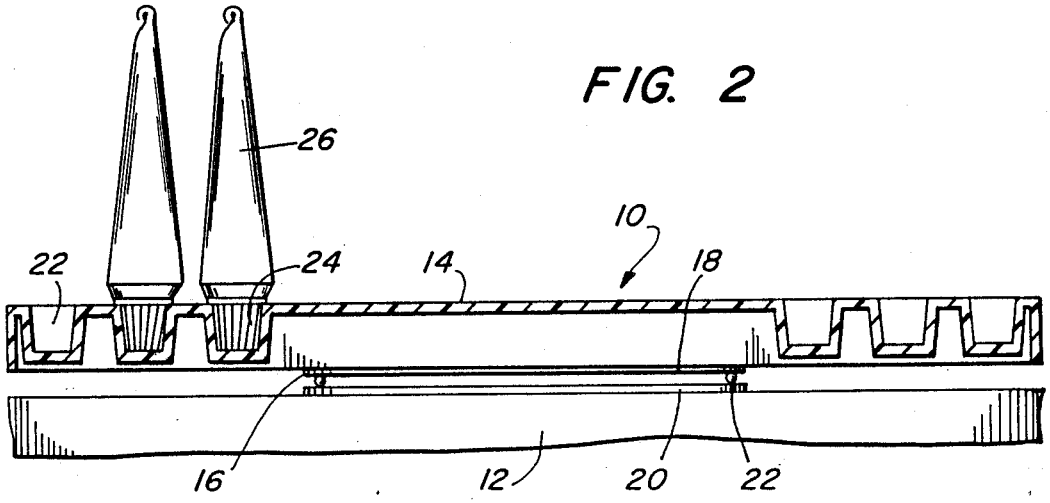
FIG. 2 is an overhead view of the merchandise support tray of the rotating merchandising stand of the present invention in which the arrangement of the truncated conical cavities utilized to support tubes of haircolor to be supported and displayed by the stand is illustrated.

Illustrated in FIG. 2 is an overhead view of merchandise support tray 14. Preferably, tray 14 is circular, and cavities 22 form a series of concentric circles thereupon. shown in FIG. 2 are sixty cavities 28 forming three concentric circles; however, the actual number and arrangement of cavities 22 may be varied.

Figure 3:
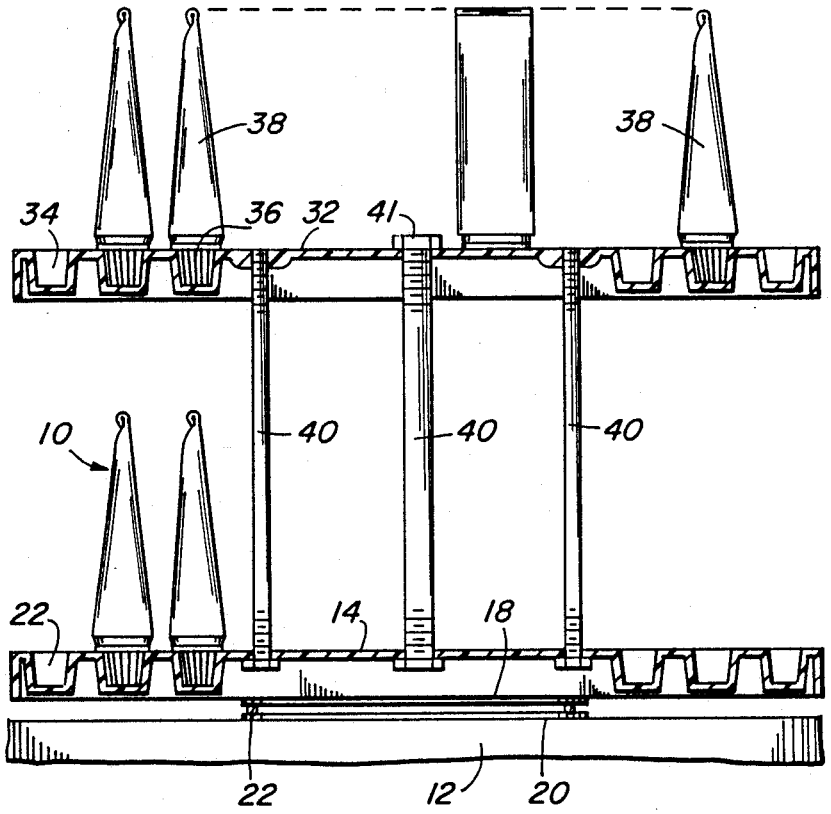
FIG. 3 is a cross-sectional view of a second embodiment of the present invention in which a second merchandise support tray is connected and supported above the first tray to support additional tubes of haircolor thereupon.

FIG. 3 illustrates a further embodiment of the (merchandising rotating) stand of the present invention. In the embodiment of FIG. 3, a second merchandise support tray 32 is positioned above first support tray 14. Merchandise support tray 32 is identical in structure to support assembly 14, and similar to cavities 22 of tray 14, tray 32 contains cavities 34 to allow tube caps 36 of tubes 38 to be supported in an upstanding position. Preferably, support tray 32 is also of a circular configuration, and cavities 34 form a series of concentric circles thereupon.

FIG. 3 illustrates an embodiment in which support trays 14 and 32 are of the same diameters. It is to be noted, however, that alternatively, tray 32 may be of a different diameter that that of support tray 14. For example, when tray 32 is of a lesser diameter than that of tray 14, a "tiered" arrangement is created.

Support tray 32 is supported above tray 14 by vertically extending support members 40. The respective ends of support members 40 may be fastened to the support trays 14 and 32 byy any conventional means. In the embodiment of FIG. 3, the support member 40 positioned at the center of support trays 14 and 32 comprises a bolt, and is fastened to tray 32 by nut member 41. Other support members are threadedly engaged threaded cavities extending through tray 32. Other fastening means are, of course, possible.

Figure 4:
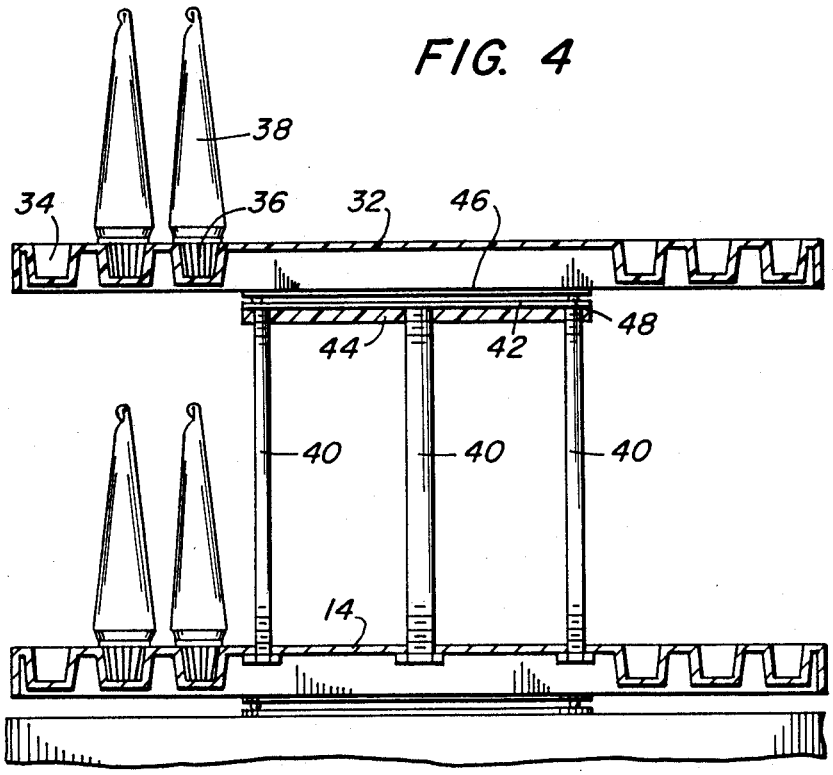
FIG. 4 is a cross-sectional view of a third embodiment of the present invention in which the second merchandise support tray is positioned above and rotatably attached to the first merchandise support tray to allow independent rotation of the second merchandise support tray.

Referring now to the illustration of FIG. 4, there is shown yet another embodiment of the rotating merchandising stand 10 of the present invention. Similar to the embodiment of FIG. 3, merchandise support tray 32 is positioned above merchandise support tray 14. In the embodiment of FIG. 4, however, vertically extending support members 40 are fastened at first end thereof to support tray 14, but fastened at second ends thereof to ball bearing unit 42. Bottom portion 44 of ball bearing unit 42 is fixedly attached to the upwardly extending support members 40, and top portion 46 of ball bearing unit 42 is fixedly attached to support tray 32. Ball bearings 48 positioned between bottom portion 44 and top portion 46 allows support tray 32 to be rotated independently of support tray 14.

In use, tube caps of a plurality of tubular containers 26 and 38 are positioned within cavities 22 and 34, respectively, to support containers 26 and 38 in upstanding positions. Because containers 26 and 38 are supported in upstanding positions, an attractive visual effect is generated, thereby enhancing consumer awareness of the containers. Use of the rotating merchandising stand 10 of the various embodiments is especially useful in the display of haircoloring products. Because haircolor must be made available in a large numbers of shades, providing a means to display eacy of the different shades of haircolor otherwise requires an inordinate amount of space.

However, by positioning and displaying tubes of haircolor on the rotating merchandise stand 10 of the present invention, each of the tubes of haircolor may be displayed so as to make the consumer visually aware of the product.

While the present invention has been described in connection with the preferred embodiments, it is to be understood that other similar embodiments may be used, or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim as my invention:

1. A rotating merchandising stand for displaying containers having truncated conical cap portions, including:

a base means;

a merchandise support assembly including a support tray rotatably coupled to said base means for supporting said containers thereupon;

said support tray having a plurality of truncated conical cavities with tapering sidewalls extending into said merchandise support assembly for insertion therewithin of said truncated conical cap portions of the containers, said truncated conical cavities forming a series of circular patterns extending about a center of said merchandise support assembly; and said tapering sidewalls of the truncated conical cavities being dimensioned to support the containers essentially only by engaging outer diameters of said truncated conical cap portions thereof by allowing one of each of said truncated conical cap portions to extend in one of the plurality of truncated cavities thereby supporting said containers in upstanding positions rising above the support tray.

2. The rotating merchandising stand of claim 1 wherein said merchandise support assembly is a circular tray.

3. The rotating merchandising stand of claim 1 wherein said containers are comprised of tubes of haircolor.

4. The rotating merchandising stand of claim 1 further including at least one vertically extending support member fixedly attached at a bottom end thereof to the merchandise support assembly.

5. The rotating merchandising stand of claim 4 wherein a second merchandise support assembly is attached to said support member at a point away from said bottom end of the support member for support thereby.

6. The rotating merchandising stand of claim 5 wherein said second merchandise support assembly includes a plurality of truncated conical cavities having tapering side walls extending into the second merchandise support assembly for engaging said truncated conical cap portions of said containers.

7. The rotating merchandising stand of claim 4 further including a second merchandise support assembly rotatably attached to said at least one vertically extending support member at a top end thereof for support thereby.

8. The rotating merchandising stand of claim 7 wherein said second merchandise support assembly includes a plurality of truncated conical cavities having tapering side walls extending into the second merchandise support assembly for engaging said truncated conical portions of said containers.

* * * * *